US009441834B2

(12) United States Patent
Colannino et al.

(10) Patent No.: US 9,441,834 B2
(45) Date of Patent: Sep. 13, 2016

(54) WIRELESSLY POWERED ELECTRODYNAMIC COMBUSTION CONTROL SYSTEM

(71) Applicant: CLEARSIGN COMBUSTION CORPORATION, Seattle, WA (US)

(72) Inventors: Joseph Colannino, Bellevue, WA (US); Igor A. Krichtafovitch, Kirkland, WA (US); Kraig K. Anderson, Burlingame, CA (US); Christopher A. Wiklof, Everett, WA (US); Harold H. Bennett, II, Kirkland, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 252 days.

(21) Appl. No.: 14/144,431

(22) Filed: Dec. 30, 2013

(65) Prior Publication Data

US 2014/0186778 A1 Jul. 3, 2014

Related U.S. Application Data

(60) Provisional application No. 61/747,175, filed on Dec. 28, 2012.

(51) Int. Cl.
*F23N 5/00* (2006.01)
*F23C 99/00* (2006.01)

(52) U.S. Cl.
CPC ..... *F23C 99/001* (2013.01)

(58) Field of Classification Search
USPC ..... 431/253, 264
See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |
| 3,087,472 | A | 4/1963 | Asakawa |
| 3,224,485 | A | 12/1965 | Blomgren et al. |
| 3,306,338 | A | 2/1967 | Wright et al. |
| 3,358,731 | A | 12/1967 | Donnelly |
| 3,416,870 | A | 12/1968 | Wright |
| 3,503,348 | A | 3/1970 | Dvirka |

(Continued)

FOREIGN PATENT DOCUMENTS

| | | |
|---|---|---|
| EP | 1139020 | 8/2006 |
| WO | WO 2015/160830 | 10/2014 |

(Continued)

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — Avinash Savani
(74) *Attorney, Agent, or Firm* — Christopher A. Wiklof; Nicholas S. Bromer; Launchpad IP, Inc.

(57) ABSTRACT

A combustion system includes an electrodynamic combustion control system that provided for electrical control of a combustion reaction. Energy is received wirelessly, and electrical energy is generated from the wirelessly received energy. The electrical energy is applied to the combustion reaction in order to control or regulate operation of first and/or second electrodes configured to apply the energy to the combustion reaction.

35 Claims, 6 Drawing Sheets

(56) References Cited

U.S. PATENT DOCUMENTS

| | | | | |
|---|---|---|---|---|
| 3,749,545 | A | 7/1973 | Velkoff | |
| 3,841,824 | A | 10/1974 | Bethel | |
| 3,869,362 | A | 3/1975 | Machi et al. | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,649,260 | A | 3/1987 | Melis et al. | |
| 4,665,740 | A * | 5/1987 | Matsumoto | G01M 15/10 73/114.09 |
| 4,675,029 | A | 6/1987 | Norman et al. | |
| 4,903,616 | A | 2/1990 | Mavroudis | |
| 4,987,839 | A | 1/1991 | Krigmont et al. | |
| 5,515,681 | A | 5/1996 | DeFreitas | |
| 5,577,905 | A * | 11/1996 | Momber | F23N 5/203 431/46 |
| 5,702,244 | A | 12/1997 | Goodson et al. | |
| 5,784,889 | A | 7/1998 | Joos et al. | |
| 6,247,921 | B1 * | 6/2001 | Helt | F23Q 3/00 361/263 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,168,427 | B2 | 1/2007 | Bachinski et al. | |
| 7,182,805 | B2 | 2/2007 | Reaves | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 8,851,882 | B2 | 10/2014 | Hartwick et al. | |
| 8,881,535 | B2 | 11/2014 | Hartwick et al. | |
| 8,911,699 | B2 | 12/2014 | Colannino et al. | |
| 9,151,549 | B2 | 10/2015 | Goodson et al. | |
| 9,209,654 | B2 | 12/2015 | Colannino et al. | |
| 2005/0208442 | A1 | 9/2005 | Heiligers et al. | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0038113 | A1 | 2/2014 | Breidenthal et al. | |
| 2014/0050644 | A1 | 2/2014 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0186778 | A1 | 7/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0234786 | A1 | 8/2014 | Ruiz et al. | |
| 2014/0234789 | A1 | 8/2014 | Ruiz et al. | |
| 2014/0248566 | A1 | 9/2014 | Krichtafovitch et al. | |
| 2014/0251191 | A1 | 9/2014 | Goodson et al. | |
| 2014/0255855 | A1 | 9/2014 | Krichtafovitch | |
| 2014/0255856 | A1 | 9/2014 | Colannino et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2014/0338350 | A1 | 11/2014 | Breidenthal et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0226424 | A1 | 8/2015 | Breidenthal et al. | |
| 2015/0241057 | A1 | 8/2015 | Krichtafovitch et al. | |
| 2015/0276211 | A1 | 10/2015 | Colannino et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0362178 | A1 | 12/2015 | Karkow et al. | |

FOREIGN PATENT DOCUMENTS

| | | |
|---|---|---|
| WO | WO 2014/197108 | 12/2014 |
| WO | WO 2015/017084 | 2/2015 |
| WO | WO 2015/017087 | 2/2015 |
| WO | WO 2015/038245 | 3/2015 |
| WO | WO 2015/042566 | 3/2015 |
| WO | WO 2015/051136 | 4/2015 |
| WO | WO 2015/051377 | 4/2015 |
| WO | WO 2015/057740 | 4/2015 |
| WO | WO 2015/089306 | 6/2015 |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

James Lawton et al., Electrical Aspects of Combustion, 1969, p. 81, Clarendon Press, Oxford, England.

* cited by examiner

WIRELESSLY POWERED ELECTRODYNAMIC COMBUSTION CONTROL SYSTEM

CROSS-REFERENCE TO RELATED APPLICATIONS

The present application claims priority benefit from U.S. Provisional Patent Application No. 61/747,175, entitled "WIRELESSLY POWERED ELECTRODYNAMIC COMBUSTION SYSTEM", filed Dec. 28, 2012; which, to the extent not inconsistent with the disclosure herein, is incorporated by reference.

BACKGROUND

In electrodynamic combustion control (ECC) systems, electrical energy is employed to control various aspects of a combustion reaction. Typically, the electrical energy is applied by electrodes in contact with, or in close proximity to the combustion reaction. For example, one known method is to position a first electrode near or in contact with the combustion reaction and employ a burner nozzle as a second electrode. A voltage is then applied across the combustion reaction between the two electrodes, producing an electrical field extending through the combustion reaction, between the electrodes. As fuel (and/or oxidizer) are emitted via the burner nozzle, an electrical charge is imparted to the fuel stream. This imparts a charge to the combustion reaction whose polarity is opposite that of the first electrode. The position of the first electrode, the polarity and magnitude of the applied voltage, and other related factors determine the effect of the electrical energy on the combustion reaction. Characteristics of the combustion reaction that can be controlled can include, for example, shape, location, luminosity, reaction rate, temperature, etc.

SUMMARY

According to an embodiment, a combustion system is provided that includes a burner nozzle configured to support a combustion reaction, and an electrodynamic combustion control (ECC) system. The ECC system includes an energy receiver configured to wirelessly receive energy and convert the received energy to electrical energy. The ECC system is configured to apply some portion of the electrical energy to a combustion reaction supported by the burner nozzle, in order to control an aspect of the combustion reaction.

According to an embodiment, the ECC system includes a first electrode operatively coupled to the energy receiver and configured to apply a portion of the electrical energy to the combustion reaction.

According to another embodiment, the ECC system includes a voltage module operatively coupled between the energy receiver and the first electrode and configured to modify the electrical energy. Modification of the electrical energy can include, for example, voltage regulation, rectification, formation of a time-based signal, etc.

According to an embodiment, the ECC system includes a power source and an energy transmitter. The energy transmitter is configured to receive energy from the power source and to wirelessly transmit the energy in a form that is receivable by the energy receiver.

According to various embodiments, the ECC system includes a controller, configured to control operation of the ECC system. In some embodiments, the controller is operatively coupled to the power source and energy transmitter, and is configured to control application of electrical energy to the combustion reaction indirectly, through control of the wireless transmission of energy. In other embodiments, the controller is operatively coupled to the energy receiver and the electrode, and is configured to directly control application of electrical energy to the combustion reaction.

According to an embodiment, a method for controlling a combustion reaction is provided, including wirelessly receiving energy, and applying a portion of the received energy to the combustion reaction.

DETAILED DESCRIPTION

Figure 1:
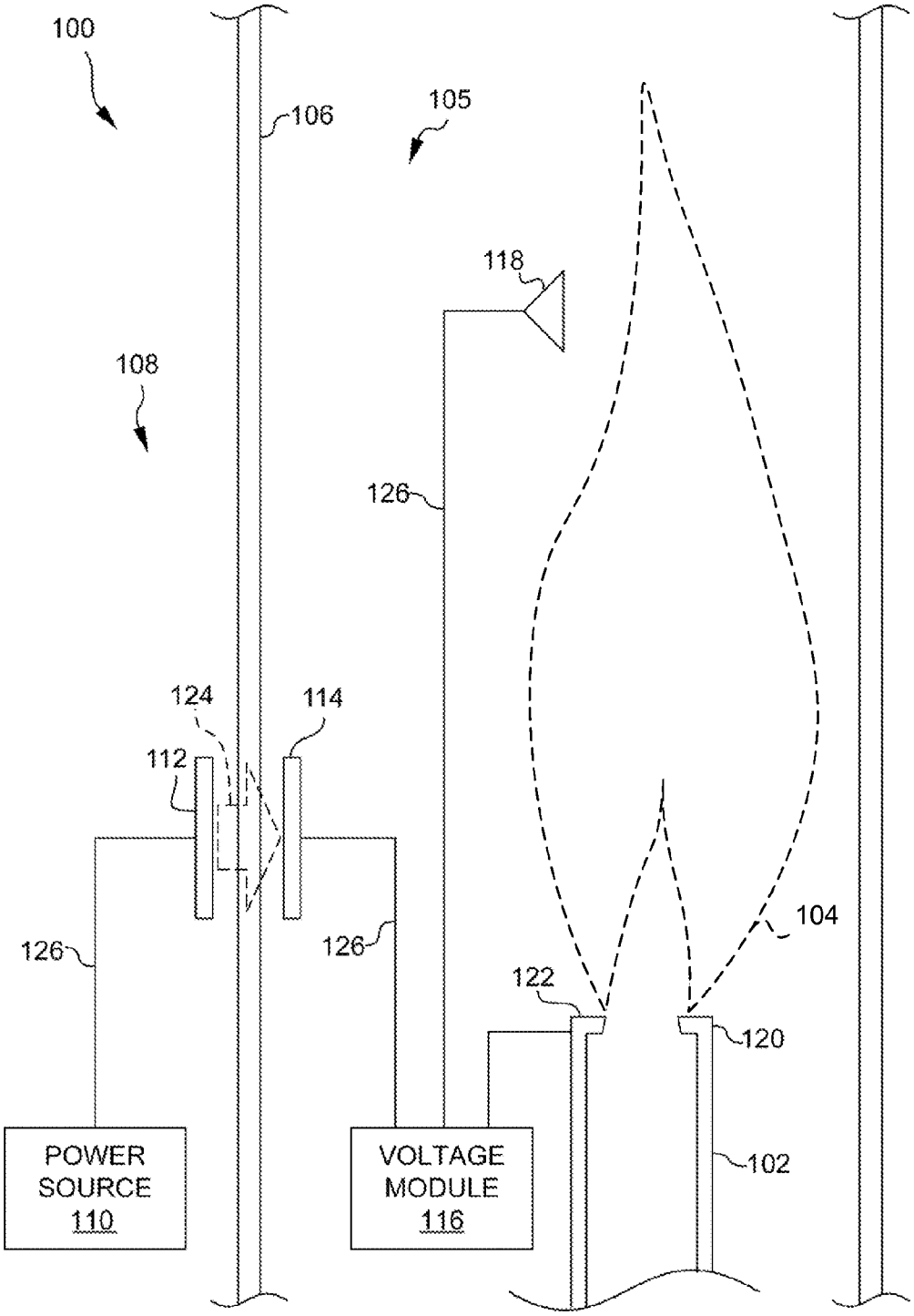
FIG. 1 is a diagram of a combustion system, according to an embodiment, which includes an electrodynamic combustion control (ECC) system configured to control an aspect of the combustion reaction.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a diagram of a combustion system 100, according to an embodiment. The combustion system 100 includes a burner 102 configured to support a combustion reaction 104, the burner being positioned within a combustion chamber 105 defined in part by walls or partitions 106. The combustion system 100 also includes an electrodynamic combustion control (ECC) system 108 configured to control an aspect of the combustion reaction 104.

The ECC system 108 includes a power source 110, an energy transmitter 112, an energy receiver 114, a voltage module 116, and a first electrode 118. Additionally, a portion or surface 120 of the burner nozzle is configured to function as a second electrode 122.

The energy transmitter 112 is configured to receive power from the power source 110 and to wirelessly transmit energy 124 into the combustion chamber 105, while the energy receiver 114 is configured to receive some portion of the transmitted energy 124 and to output electrical energy. According to some embodiments, the energy transmitter 112 and the energy receiver 114 are configured to couple in a manner that permits transmission and reception of electrical energy, which is then outputted by the energy receiver to the voltage module 116. According to other embodiments, the energy transmitter 112 is configured to transmit energy in a non-electrical form, and the energy receiver 114 is configured to convert a portion of the transmitted energy into electrical energy. Some of these various embodiments will be described in more detail later. As used herein, the term electrical energy is to be understood as including electromagnetic energy.

The first and second electrodes 118, 122 are operatively coupled to the voltage module 116 and configured to apply electrical energy to the combustion reaction 104. In the example shown in FIG. 1, the second electrode 122 is formed by the portion 120 of the burner nozzle 102, and acts to impart an electrical charge to the combustion reaction 104. Characteristics of the electrical energy applied by the first electrode 118 are selected to interact with the combustion reaction 104 according to the polarity and magnitude of the charge imparted by the second electrode 122, to control an aspect or characteristic of the combustion reaction. The second electrode 122 can also be configured to function as a flame holder, holding a reaction front of the combustion reaction at or near the second electrode, and enabling the use of an increased rate of fuel emission from the burner nozzle 102 while maintaining stable operation of the combustion system 100.

FIGS. 2-5 are diagrams showing in more detail the energy transmitter 112 and energy receiver 114 according to respective embodiments. In the embodiment shown in FIG. 2, the energy transmitter 112 and energy receiver 114 are configured to be capacitively coupled. A portion 202 of the partition 106 of the combustion chamber 105 is thinned. The portion 202 of the partition 106 is preferably made from a non-conductive material, such as, e.g., fused quartz, or an appropriate ceramic material, etc. The energy transmitter 112 includes a first electrically conductive plate 204 positioned outside the combustion chamber 105 very close to or in contact with a first surface 206 of the thinned portion 202 of the partition 106. Similarly, the energy receiver 114 includes a second electrically conductive plate 208 positioned very close to or in contact with a second surface 210 of the thinned portion 202 of the partition 106, directly opposite the first plate 204. The first and second electrically conductive plates 204, 208 can be thin pieces of a conductive material, such as metal, that is attached to the respective first and second surfaces 206, 210, or they can be formed by other processes, such as, for example, plating or painting a conductive material onto the respective surfaces.

Figure 2:
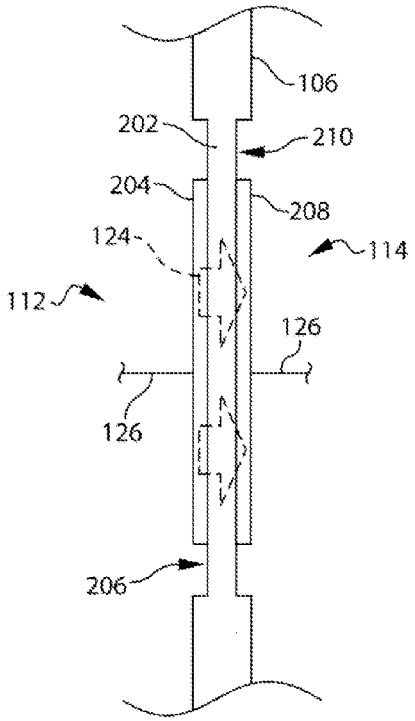
FIGS. 2-5 are diagrams showing in more detail the energy transmitter and energy receiver of the system of FIG. 1, according to respective embodiments.

According to the embodiment of FIG. 2, the power source 110 is configured to apply a first alternating polarity voltage (AC) signal to the first electrically conductive plate 204. In accordance with very well known principles, the first AC signal at the first plate 204 produces a corresponding second AC signal at the second electrically conductive plate 208 having a same frequency and an opposite phase. The frequency of the first and second AC signals is preferably selected to optimize the energy transfer between the first and second plates 204, 208.

The second AC signal is received by the voltage module 116 and modified as necessary to produce an output signal that is supplied to the first and/or second electrodes 118, 122. According to various embodiments, the voltage module 116 can include circuits for performing a number of different operations. For example, in embodiments in which a DC output signal is to be applied to the first and/or second electrodes 118, 122, the voltage module 116 is configured to rectify the second AC signal. In embodiments in which a high-voltage signal is required, i.e., a signal having a voltage that is greater than the maximum voltage of the second AC signal, the voltage module 116 can be configured to increase the voltage, via, for example, a voltage multiplier circuit, etc. Where an output signal of a particular frequency is required, which does not correspond to the frequency of the first and second AC signals, the voltage module 116 can include an oscillator circuit configured to produce the desired frequency.

Figure 3:
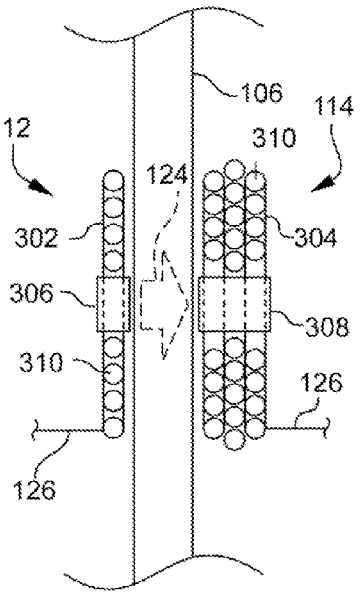

In the embodiment shown in FIG. 3, the energy transmitter 112 and energy receiver 114 are configured to be inductively coupled. The energy transmitter 112 includes a first coil 302 positioned outside the combustion chamber 105 adjacent to the partition 106, and the energy receiver 114 includes a second coil 304 positioned adjacent to the partition 106, directly opposite the first coil 302. At least the portion of the partition between the energy transmitter 112 and energy receiver 114 is non-conductive and permeable by magnetic flux. Essentially, the first and second coils 302, 304 act as, respectively, the primary and secondary windings of a transformer that is divided by the partition 106. In the embodiment shown, the first and second coils 302, 304 include respective first and second ferrite cores 306, 308, to improve inductive coupling. As with the embodiment of FIG. 2, the voltage module 116 is configured to supply a first AC signal to the first coil 302, which generates a corresponding second AC signal in the second coil. Electrical energy from the second AC signal can then be modified as required, and supplied to the first and second electrodes 118, 122.

The first and second coils 302, 304 each comprise a plurality of loops 310 of wire. It can be seen, in FIG. 3, that the second coil 304 has many more loops 310 than the first coil 302. As is well understood in the art, the output voltage of a transformer is related to the input voltage according to the ratio of the number of turns in the secondary winding relative to the number of turns in the primary winding. Thus, in the embodiment of FIG. 3, the second AC signal will have a much higher voltage than the first AC signal. By selection of the respective numbers of loops in the first and second coils 302, 304—according to well known principles—a selected voltage multiplication factor can be obtained.

Figure 4:
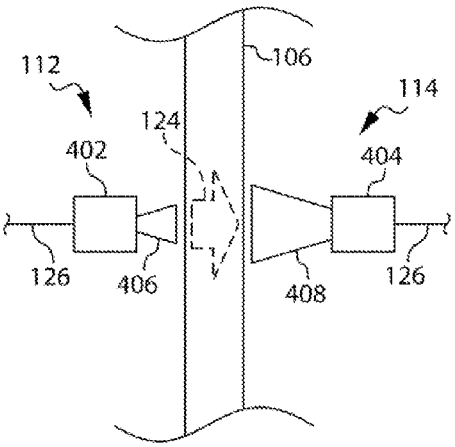

Turning now to FIG. 4, an embodiment is shown in which the energy transmitter 112 includes a microwave emitter 402 positioned outside the combustion chamber 105 adjacent to the partition 106, while the energy receiver 114 includes a microwave receiver 404 positioned adjacent to the partition 106, directly opposite the microwave emitter. The corresponding portion of the partition 106 is preferably permeably to microwaves of a selected frequency. The power source 110 can be configured to produce a first AC signal at the appropriate microwave frequency—typically between about 300 MHz and 300 GHz—or the emitter 404 can include an oscillator configured to receive a DC signal or a lower-frequency AC signal and to output a microwave-signal frequency. Microwaves transmitted by the emitter 402 are received by the receiver 404, which produces a corresponding AC signal, which is modified as appropriate by the voltage module, as previously described. Horns 406, 408 (as shown in FIG. 4) reflectors, waveguides, etc., can be employed to channel or focus microwave energy, in order to reduce energy losses and/or to permit locating of the emitter 402 and/or the receiver 404 at locations that are removed from positions directly opposite each other on respective sides of the partition 105.

Figure 5:
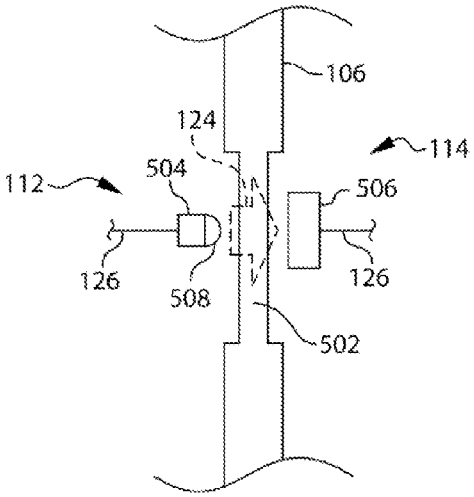

In the embodiment shown in FIG. 5, the energy transmitter 112 and energy receiver 114 are configured to be optically coupled. A portion 502 of the partition 106 of the combustion chamber 105 is configured to be transparent to selected wavelengths of light. The energy transmitter 112 includes a light emitter 504, such as, for example, a diode or laser, positioned outside the combustion chamber 105 adjacent to the portion 502 of the partition 106. The energy receiver 114 includes an optical receiver 506, such as, e.g., a photovoltaic cell, positioned inside the combustion chamber 105, adjacent to the portion 502 of the partition 106 and directly opposite the light emitter 504. The light emitter 504 is configured to receive an electrical signal from the power source 110 and convert the signal to an optical signal, which is transmitted via the portion 502 to the optical receiver 506. For its part, the optical receiver 506 is configured to convert optical energy, i.e., light emitted by the emitter 504, into electrical energy for use by the voltage module. The optical emitter 504 can include a lens 508 configured to focus emitted light on the receiver 506. Alternatively, a lens can be positioned between the emitter and receiver, either as an integral part of the portion 502 of the partition 506, or as a separate element.

Figure 6A:
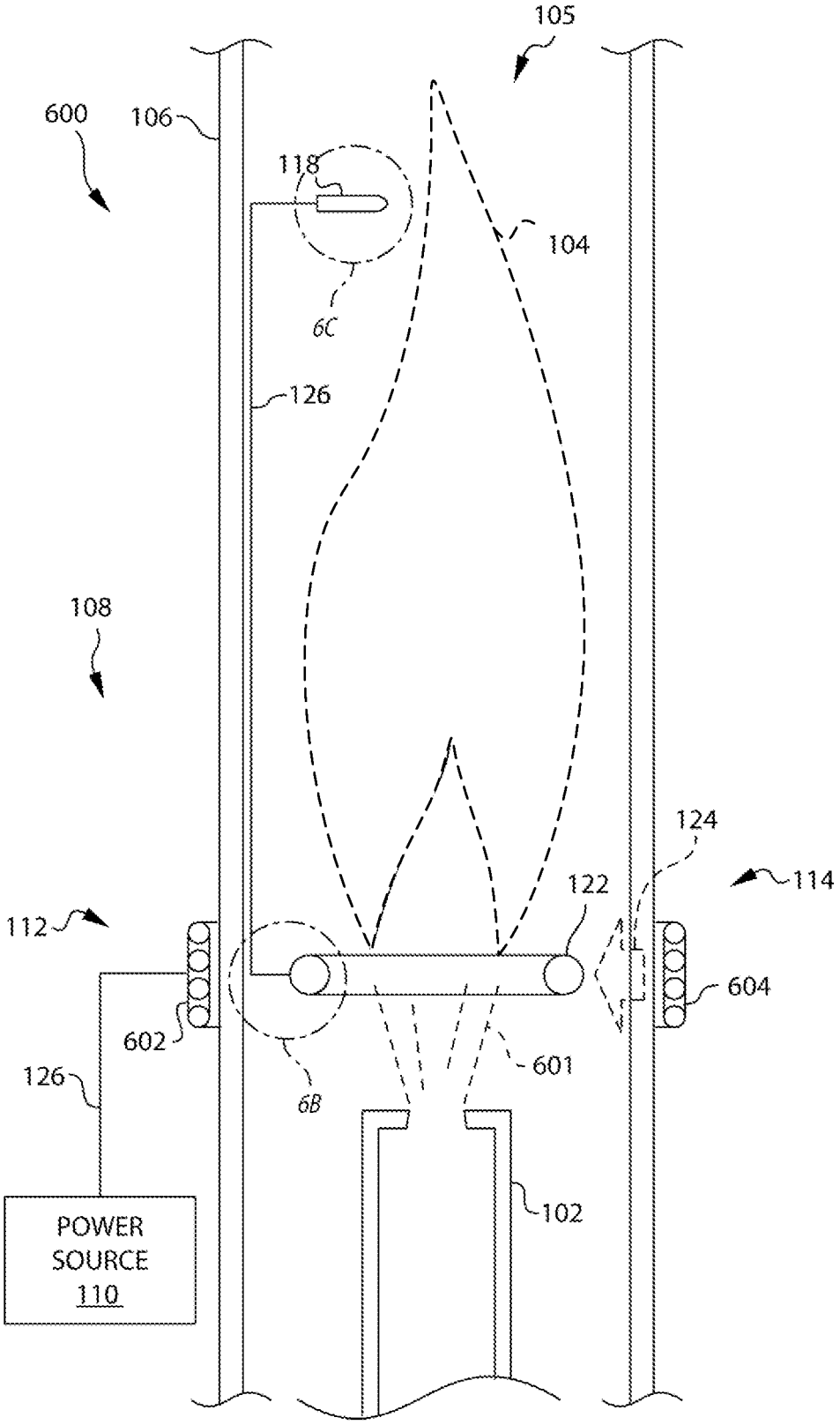
FIG. 6A is a diagram of a combustion system according to another embodiment.
Figure 6B:
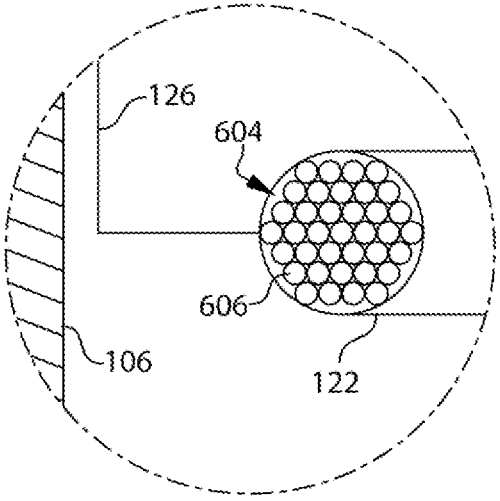
FIGS. 6B and 6C are enlarged views showing additional details of the system of FIG. 6A, as indicated in FIG. 6A at 6B and 6C, respectively.
Figure 6C:
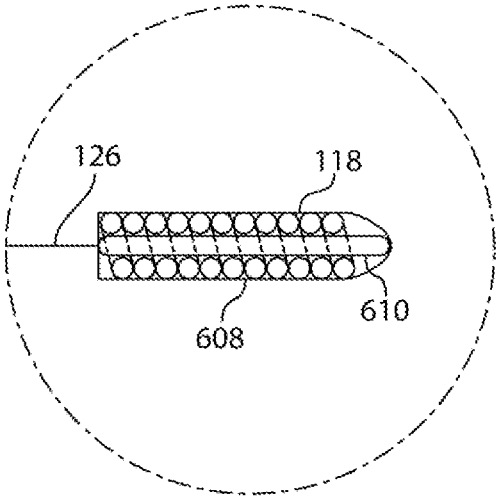

Turning now to FIGS. 6A-6C, a combustion system 600 is shown, according to another embodiment. FIG. 6A is a diagram of the combustion system 600, while FIGS. 6B and 6C are enlarged views showing additional details of the system 600, as indicated in FIG. 6A at 6B and 6C, respectively.

The combustion system 600 includes a burner nozzle 102 configured to emit a fuel jet 601 and support a combustion reaction 104. The burner nozzle 102 is positioned within a combustion chamber 105 defined in part by a cylindrical partition 106, and an ECC system 108 that includes a power source 110, an energy transmitter 112, an energy receiver 114, and first and second electrodes 118, 122. In the embodiment of FIG. 6A, the combustion chamber 106 is relatively narrow, so that the combustion reaction 104 occupies much of the combustion chamber. The energy transmitter 112 includes a first coil 602 that extends around the circumference of the cylindrical partition 106. The second electrode 122 is in the shape of a toroid and is positioned a distance from the burner nozzle 102. In operation, the transmitter 112 generates an electromagnetic field that is oriented coaxially with the burner nozzle 102, the partition 106, and the second electrode 122. In the embodiment shown, the second electrode 122 acts as a flame holder, holding a combustion front at approximately the level of the second electrode.

FIG. 6B is an enlarged view of a portion of the second electrode 122, and shows that the second electrode includes a second coil 604 having a plurality of loops or turns 606. Thus, the electromagnetic field generated by the transmitter 112 generates a corresponding current in the second coil 604, focusing the electromagnetic field and producing a charge in the combustion reaction 104. The second electrode, therefore, functions also as the energy receiver 114, receiving the energy transmitted by the first coil 602. The second electrode is operatively coupled to the first electrode 118 so that current in the second coil 604 is transmitted via a connector 126 to the first electrode 118.

FIG. 6C is an enlarged cross-sectional view of the first electrode 118, and shows that the first electrode includes a third coil 608 wrapped around a ferrite core 610 and oriented normal to longitudinal axes of the burner nozzle 102 and the cylindrical partition 106. Current generated in the second coil 604 is transmitted to the first electrode 118, where the third coil 608 generates a second electromagnetic field that is perpendicular to the first electromagnetic field, and that interacts with the combustion reaction 104 according to its polarity and strength. The polarity of the second electromagnetic field is determined by the direction of the windings of the third coil 608, and the strength is controlled, in part, by the number of windings in the third coil and the magnitude of the current.

According to an embodiment, elements of a combustion system that are provided with active or passive protection from thermal energy that may be present within the combustion chamber.

Figure 7:
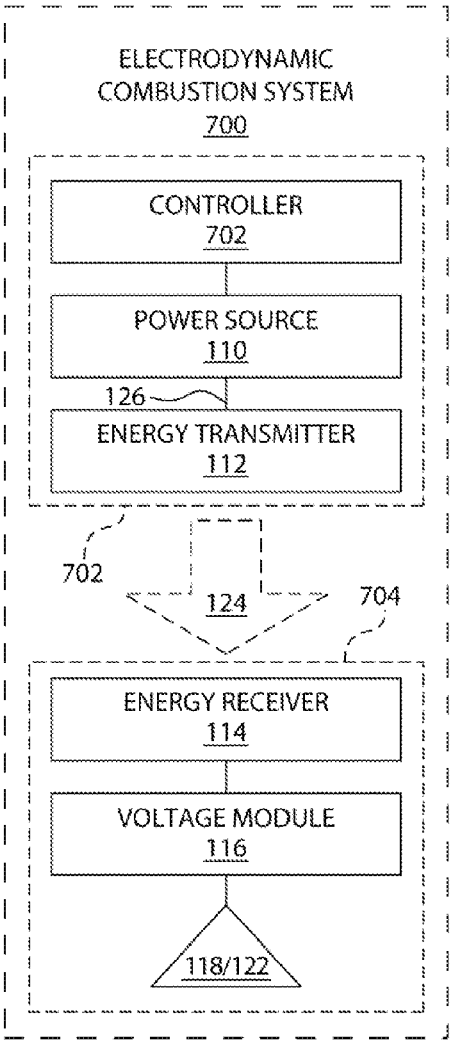
FIGS. 7 and 8 are schematic diagrams showing the arrangement of elements of the ECC according to respective embodiments.
Figure 8:
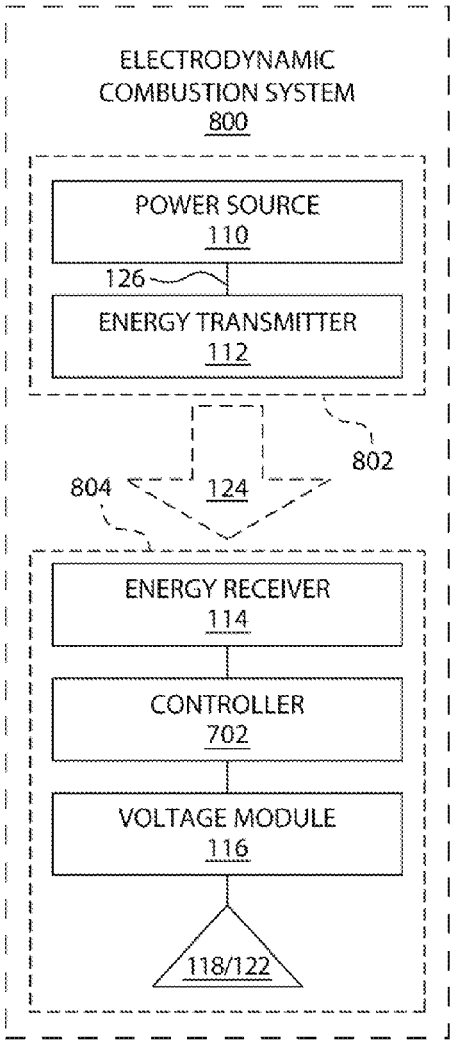

FIGS. 7 and 8 are schematic diagrams showing the arrangement of elements of ECC systems 700, 800 according to respective embodiments. The ECC systems 700, 800 are configured for use with combustion systems such as those described with reference to previous embodiments. Looking first at the embodiment of FIG. 7, the ECC system 700 is shown, including a power transmission module 702 and a combustion control module 704. Elements of the power transmission module 702 are configured to be positioned outside the combustion chamber of a corresponding combustion system, while elements of the combustion control module 704 are configured to be positioned inside the combustion chamber. The power transmission module 702 is configured to wirelessly transmit energy 124, and the combustion control module 704 is configured to receive the transmitted energy.

The power transmission module 702 includes a controller 706, a power source 110, and an energy transmitter 112. The controller 706 is operatively coupled to the power source 110 and is configured to control operation of the power source and energy transmitter 112. The combustion control module 704 includes an energy receiver 114 a voltage module 116, and first and second electrodes 118, 122. The energy receiver 114 and voltage module 116 are configured to drive the first and second electrodes 118, 122 according to preset parameters any time energy 124 is present in quantities sufficient to energize the energy receiver 114. The controller 706 can be configured to receive data from sensors configured to monitor relevant characteristics of the combustion reaction 104, and to control the wireless transmission of energy 124 by the energy transmitter 112. In this way, the controller 706 can indirectly control operation of the energy receiver 114, the voltage module 116, and the first and second electrodes 118, 122 so as to maintain the controlled aspects of the combustion reaction within acceptable limits.

The ECC system 800 of FIG. 8, includes a power transmission module 802 and a combustion control module 804, and the elements of these modules are in most respects identical to those of the ECC system 700. However, the controller 706 of the ECC system 800 is part of the combustion control module 804, operatively coupled to the energy receiver 114 and the voltage module 116, and configured to control operation of the voltage module to drive the first and/or second electrodes 118, 122. Thus, one distinction is that the controller 706 of the combustion control module 804 is configured to directly control the application of energy to the combustion reaction via the electrodes 118, 122, where in the embodiment of FIG. 7, the control is indirect. As with other embodiments, the controller 706 of FIG. 8 can be configured to monitor relevant characteristics of the combustion reaction 104 via sensors and other sources, and to control operation of the energy receiver 114, the voltage module 116, and the electrodes 118, 122 so as to maintain the relevant characteristics within selected tolerances. According to an embodiment, the energy transmitter 112 of the power transmission module 802 can be configured to transmit energy 124 continually, while the controller 706 is configured to enable the energy receiver 114 to receive the energy only when necessary.

Although shown in FIGS. 7 and 8 as separate elements coupled via a connector 126, functions described as being performed by separate elements can be combined to be performed by a smaller number of elements. For example, with reference to the embodiment of FIG. 7, the power transmission module 702 can be a single device designed and configured to perform the functions of the controller 706, the power source 110, and the energy transmitter 112. Where the claims recite separate elements configured to perform respective individual functions, such claim language is to be construed as reading on devices configured to perform the claimed functions of a plurality of the claimed elements.

In other embodiments, elements can be omitted from the ECC system, where such elements are not required. For example, the ECC system 108 of FIGS. 6A-6C does not include a voltage module, while the functions of the energy receiver and the second electrode are combined into a single element.

Figure 9:
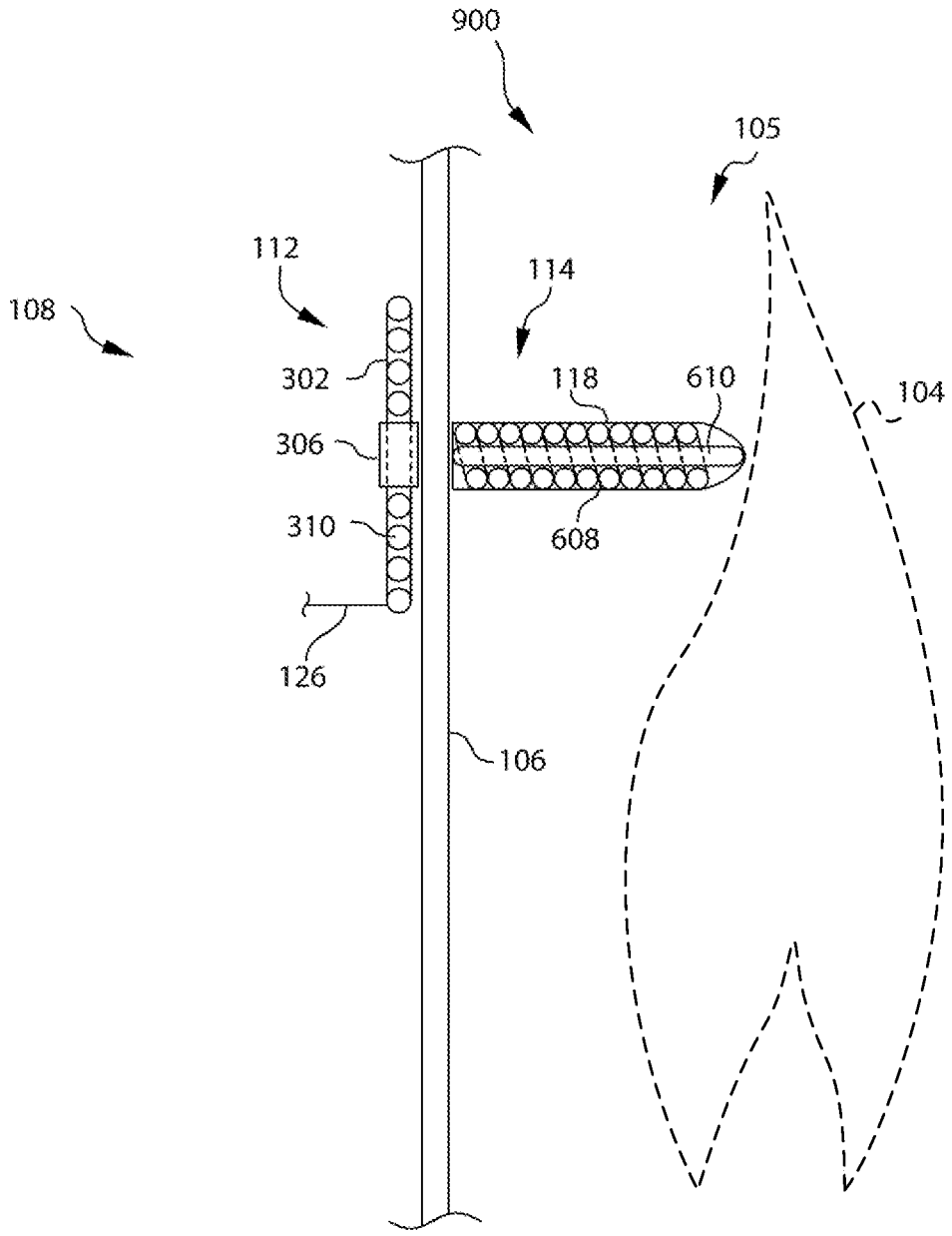
FIG. 9 is a diagram showing selected details of a combustion system, according to an embodiment.

FIG. 9 is a diagram showing selected details of a combustion system 900, according to an embodiment. The combustion system 900 is similar in many respects to the embodiments described above with reference to FIG. 1 and FIG. 6A. In particular, elements that are not shown are described in detail elsewhere. The combustion system 900 includes an ECC system 108 that includes an energy transmitter 112 and an energy receiver 114 configured to be inductively coupled. The energy transmitter 112 is similar in structure to the energy transmitter 112 described with reference to FIG. 3, and includes a first coil 302 positioned outside the combustion chamber 105 adjacent to the partition 106. The energy receiver 114 is similar in structure to the first electrode 118 described with reference to FIG. 6C, including a coil 608 wrapped around a ferrite core 610, and configured to function as a first electrode 118. However, according to the embodiment of FIG. 9, the energy receiver 114 is not coupled via a connector to another element, but is instead positioned adjacent to the partition 106, directly opposite the first coil 302.

A charge can be imparted to the combustion reaction 104 using, for example, any of the structures and methods described with reference to previous embodiments. When the first coil 302 is energized, it generates an electromagnetic field that interacts with the coil 608 and ferrite core 610 of the energy receiver 114, generating a current in the coil 608. The current in the coil 608 focuses and extends the electromagnetic field, which interacts with the combustion reaction as described elsewhere.

One advantage of the embodiment of FIG. 9 is that it can be configured so that there are no connectors extending lengthwise alongside the combustion reaction 104 within the combustion chamber 106. This can be advantageous in applications where such connectors would be susceptible to damage by the combustion reaction.

Some benefits that can be obtained by practice of various embodiments include a combustion system in which there are few or no openings that traverse the partition 106, particularly in regions where heat from the combustion reaction is greatest. Additionally, various of the embodiments provide for a combustion system that is fully electrically isolated from electrical contact with a municipal power grid, or other general source of power.

Ordinal numbers, e.g., first, second, third, etc., are used in the claims according to conventional claim practice, i.e., for the purpose of clearly distinguishing between claimed elements or features thereof. The use of such numbers does not suggest any other relationship, e.g., order of operation or relative position of numbered elements. Furthermore, ordinal numbers used in the claims have no specific correspondence to those used in the specification to refer to elements of disclosed embodiments on which those claims read, nor to numbers used in unrelated claims to designate similar elements or features.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

an electrodynamic combustion control system, including:

an energy transmitter configured to transmit energy in a wireless form;

an energy receiver, separate from the energy transmitter, configured to wirelessly receive the energy transmitted from the energy transmitter and convert the received energy to a form of electrical energy; and a first electrode operatively coupled to the energy receiver and configured to apply a portion of the electrical energy to a combustion reaction.

2. The combustion system of claim 1, wherein the electrodynamic combustion control system includes a voltage module operatively coupled between the energy receiver and the first electrode and configured to modify the electrical energy.

3. The combustion system of claim 2, wherein the electrodynamic combustion control system includes a controller configured to control operation of the voltage module.

4. The combustion system of claim 2, wherein the voltage module is configured to regulate a voltage of the electrical energy.

5. The combustion system of claim 2, wherein the voltage module is configured to rectify a voltage of the electrical energy.

6. The combustion system of claim 2, wherein the voltage module is configured to convert the electrical energy to a time-varying voltage signal.

7. The combustion system of claim 1, wherein the energy receiver includes a photoelectric transducer.

8. The combustion system of claim 1, wherein the energy receiver includes an inductor configured to inductively couple with an inductive energy transmitter.

9. The combustion system of claim 1, wherein the energy receiver is configured to capacitively couple with an energy transmitter.

10. The combustion system of claim 1, wherein the energy receiver includes a microwave receiver.

11. The combustion system of claim 1, wherein the electrodynamic combustion control system includes a power source configured to provide power to the energy transmitter.

12. The combustion system of claim 11, wherein the electrodynamic combustion control system includes a controller operatively coupled to the power source and configured to modify the power provided by the power source to the energy transmitter.

13. The combustion system of claim 1, wherein the energy transmitter is configured to transmit photonic energy, and the energy receiver includes a photoelectric transducer configured to convert photonic energy to electrical energy.

14. The combustion system of claim 1, wherein the energy transmitter includes a first inductive element and the energy receiver includes a second inductive element spaced apart from the first inductive element, the first and second inductive elements being configured to couple electromagnetically.

15. The combustion system of claim 14, wherein the first inductive element includes a first plurality of coils and the second inductive element includes a second plurality of coils, the first plurality being greater than the second plurality.

16. The combustion system of claim 1, comprising a combustion chamber defined in part by a partition, and wherein the partition is positioned between the energy transmitter and the energy receiver.

17. The combustion system of claim 16, wherein the first electrode includes the energy receiver.

18. The combustion system of claim 16, wherein the energy receiver is configured to couple inductively with the energy transmitter.

19. The combustion system of claim 1, wherein the first electrode is configured to act as a flame holder.

20. The combustion system of claim 1, wherein the electrodynamic combustion control system includes a second electrode operatively coupled to the energy receiver and configured to apply a respective portion of the electrical energy to the combustion reaction.

21. The combustion system of claim 1, comprising a burner nozzle operatively coupled to the energy receiver, a portion of the burner nozzle being configured to act as the second electrode.

22. A combustion system, comprising:

a combustion chamber configured to contain a combustion reaction;

a burner nozzle configured to support the combustion reaction;

an energy transmitter positioned outside the combustion chamber and configured to wirelessly transmit energy into the combustion chamber; and an energy receiver positioned inside the combustion chamber and configured to wirelessly receive the transmitted energy and to produce therefrom a form of electrical energy, the electrical energy being sufficient to control an aspect of the combustion reaction by application of a portion of the transmitted energy to the combustion reaction.

23. The combustion system of claim 22, comprising a combustion control module.

24. The combustion system of claim 23, wherein the combustion control module includes the energy receiver being configured to wirelessly receive the transmitted energy and to produce therefrom the electrical energy, and a first electrode configured to apply electrical energy to the combustion reaction.

25. The combustion system of claim 24, wherein the combustion control module includes a voltage module operatively coupled to the energy receiver and the first electrode, and configured to modify the electrical energy produced by the energy receiver and to provide modified electrical energy to the first electrode.

26. The combustion system of claim 23, wherein the energy transmitter is configured to transmit the energy by inductive coupling with the combustion control module.

27. The combustion system of claim 23, wherein the energy transmitter is configured to transmit the energy by capacitive coupling with the combustion control module.

28. The combustion system of claim 23, wherein the energy transmitter is configured to transmit the energy by optical coupling with the combustion control module.

29. The combustion system of claim 22, wherein the energy transmitter is configured to transmit the energy as a microwave signal.

30. A method, comprising:

wirelessly transmitting energy from outside the combustion chamber;

wirelessly receiving the energy from within a combustion chamber; and applying a portion of the received energy as a form of electrical energy to a combustion reaction within the combustion chamber.

31. The method of claim 30, comprising wirelessly transmitting the energy through a partition of the combustion chamber.

32. The method of claim 30, wherein the wirelessly transmitting the energy includes generating a signal by induction, and the wirelessly receiving energy includes receiving the generated signal by induction.

33. The method of claim 30, wherein the wirelessly transmitting the energy includes applying an electrostatic signal to a first conductive element, and the wirelessly receiving energy includes receiving the energy from a second conductive element that is capacitively coupled with the first conductive element.

34. The method of claim 30, wherein the wirelessly transmitting the energy includes generating and transmitting an optical signal, and the wirelessly receiving energy includes receiving the transmitted optical signal and converting the received optical signal to electrical energy.

35. The method of claim 30, wherein the wirelessly transmitting the energy includes generating and transmitting a microwave signal, and the wirelessly receiving energy includes receiving the microwave signal.

* * * * *